United States Patent [19]

Wolak et al.

[11] 3,998,484

[45] Dec. 21, 1976

[54] SLIDING DOOR LOCKING DEVICE

[75] Inventors: Norbert S. Wolak, Cicero; Leonidas Jaras, Chicago; Thomas J, Wolak, Cicero, all of Ill.

[73] Assignee: Evans Products Company, Portland, Oreg.

[22] Filed: Jan. 10, 1975

[21] Appl. No.: 539,965

[52] U.S. Cl. ..... 292/283

[51] Int. Cl.[2] ..... E05C 19/08

[58] Field of Search ..... 292/DIG. 32, DIG. 49, 292/283, 281, 282, 284

[56] References Cited

UNITED STATES PATENTS

| | | | |
|---|---|---|---|
| 1,223,389 | 4/1917 | Hynes | 292/DIG. 32 |
| 2,387,109 | 10/1945 | Beauchamp et al. | 292/DIG. 32 |
| 2,442,031 | 5/1948 | Beauchamp | 292/DIG. 32 |
| 3,021,162 | 2/1962 | Jahn | 292/DIG. 49 |
| 3,240,523 | 3/1966 | Heimann | 292/DIG. 71 |

*Primary Examiner*—Richard E. Moore
*Attorney, Agent, or Firm*—F. Travers Burgess

[57] ABSTRACT

The invention provides a locking device for railway freight car doors including a wedge-shaped locking pin engageable with the hasp for maintaining the door tightly closed, the wedge being so mounted that it need not be withdrawn from locking position to permit release of the lock.

14 Claims, 5 Drawing Figures

SLIDING DOOR LOCKING DEVICE

BACKGROUND OF THE INVENTION

1. Field of the Invention

The invention relates to locks for sliding doors and more particularly to locks for sliding doors of railway freight cars and the like.

2. The Prior Art

All prior art disclosures of railway car sliding door locks incorporating wedge-shaped locking pins of which applicant is aware have the wedges as well as the lock operators mounted on the car side wall adjacent the door opening and require manual withdrawal of the wedge-shaped locking pin to permit release of the lock.

SUMMARY OF THE INVENTION

The invention provides a locking device for sliding doors including a wedge-shaped locking pin so arranged that it need not be removed from its locking position to permit release of the lock. It also provides a locking device having a bellcrank actuator connected to a hasp to form an over-the-center toggle when in locking position. It further provides an improved seal latch for latching the operating handle in locking position automatically upon being moved to locking position.

To achieve the objective of eliminating the need for withdrawal of the locking pin from locking position to permit release of the lock, the locking pin is vertically slidably mounted on the door and the hasp is releasably connected to the door and fixedly connected to the bellcrank operator mounted on the car wall adjacent the door, as distinguished from devices of the prior art in which the locking pin is mounted on the car wall adjacent the actuator and must be vertically withdrawn from locking position to permit release of the lock.

DETAILED DESCRIPTION

Figure 1:
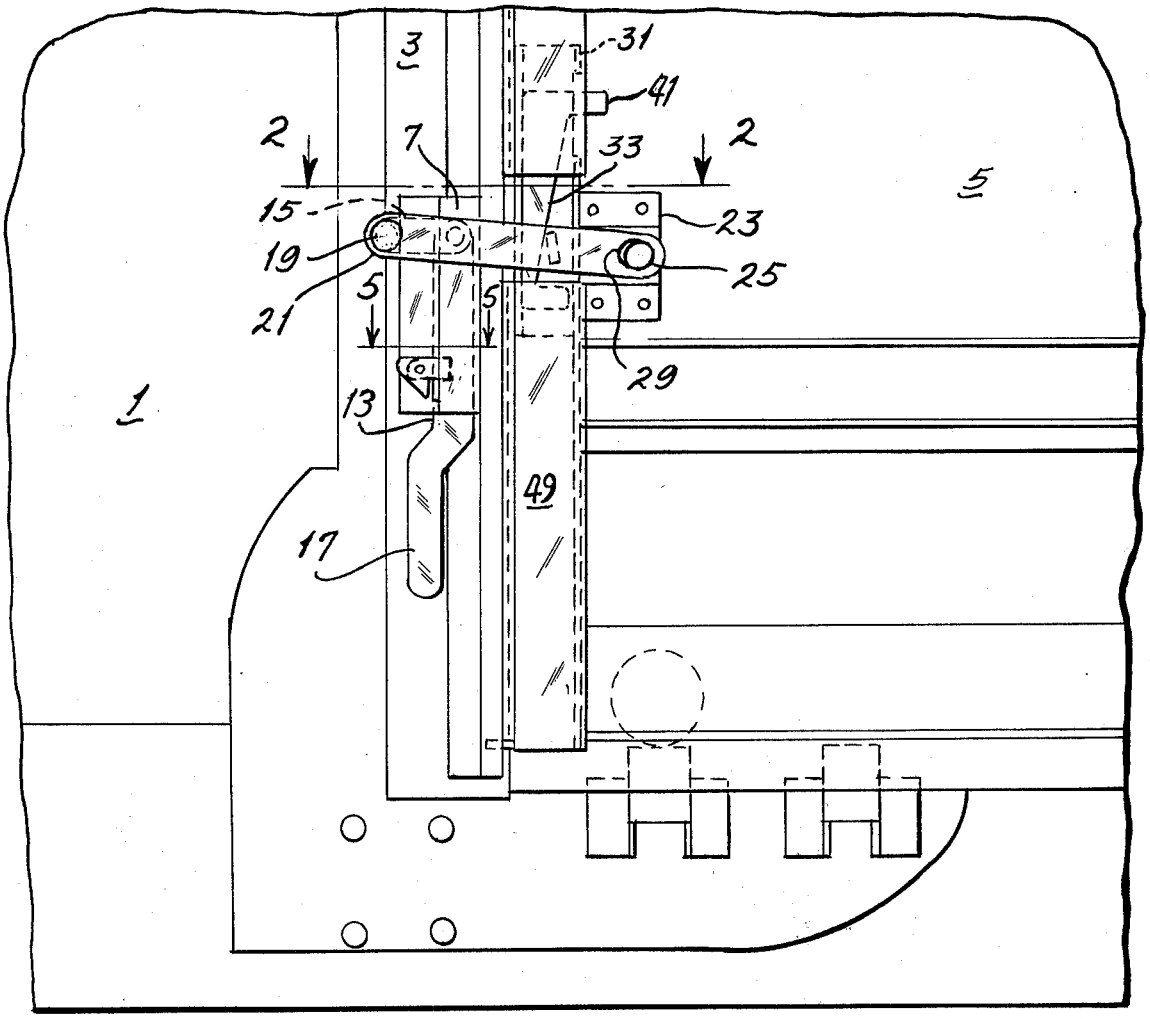
FIG. 1 is a view of a portion of a car side wall and door slidably mounted thereon showing a locking device, constructed according to the invention, in locked position.

The numeral 1 refers to a railway car side wall having a door opening therein defined by front door post 3 and closed by sliding door 5.

The locking device comprises a vertically disposed channel-shaped bracket 7 secured to door post 3 by offset extended terminal 8 of its inner flange, with its flanges parallel to the wall and its web toward the door opening. The actuator for the locking device consists of a bellcrank lever having a normally vertical arm 13 and a normally generally horizontal arm 15 fulcrumed within channel bracket 7 at 9 on a pin 11 extending between the flanges of channel bracket 7. Vertical arm 13 normally extends downwardly within channel bracket 7 and has an offset portion 17 projecting from the lower end of bracket 7 and forming an operating handle. Horizontal arm 15 is much shorter than vertical arm 13, 17 and extends away from the door opening. At its outer end, arm 15 mounts a pivot pin 19 from which is swingably supported hasp 21.

Some distance inwardly from the front edge of door 5 a bracket 23 is secured to the door and mounts means for detachably securing hasp 21 to the door, comprising a protruding pin 25 with an enlarged head 27. Hasp 21 is formed with a hole 29 in its end remote from its connection by pin 19 to actuating lever arm 15 and so positioned that when door 5 approaches closed position, by swinging bellcrank 13, 15 to the position shown in FIG. 4 in which arm 13 is substantially horizontal and arm 15 is substantially vertical, hasp 21 can be connected to door mounted pin 25 by positioning the latter in hole 29 and bellcrank lever 13, 15 swung from the position of FIG. 4 to that shown in FIGS. 1–3 wherein arm 15 and hasp 21 function as an over-the-center toggle, thereby drawing door 5 toward engagement with stop member 4 on door post 3.

In order to maintain the door in tight engagement with stop member 4, a vertical outwardly facing channel member 31 secured to the door adjacent its front edge vertically slidably mounts a wedge-shaped locking pin 33 which has a vertical front edge 35 in slidable engagement with leading flange 37 of channel member 31 and a tapering rear edge 39. At its top, locking pin 33 is formed with a rearwardly projecting handle portion 41 and the rear flange 43 of channel 31 is cut away, as at 45, to permit projection through flange 43 of handle portion 41. At its lower end locking pin 33 is formed with a rearward extension 47 substantially the full width of channel 31 to guide the locking pin vertically in the channel. The front edge member 48 of the door is of generally Z-section with a flange 49 overlying locking pin guide channel 31 to form a pocket for retention of locking pin 33 therein, flange 49 being cut away in the region of hasp 21, to permit the exposure of the intermediate portion of locking pin 33.

Figure 3:
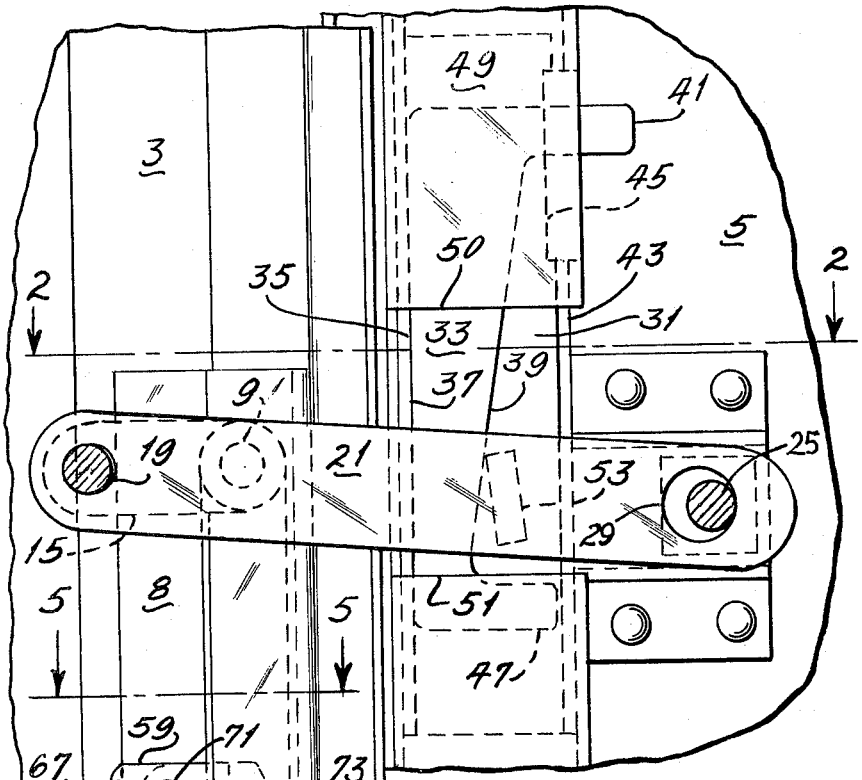
FIG. 3 is a sectional view of the locking device in locked position taken along lines 3—3 of FIG. 2.
Figure 5:
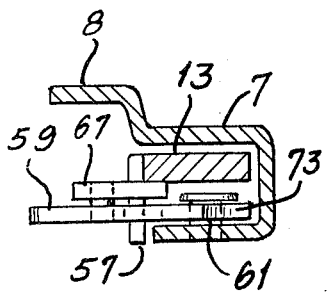
FIG. 5 is a horizontal sectional view along lines 5—5 of FIGS. 1 and 3, showing the seal latch.

Hasp 21 is formed on its inner surface with transverse surface means comprising an inwardly extending nearly vertical boss 53 positioned between locking pin 33 and hasp connection pin 25 and extending into channel 31 adjacent locking pin 33 such that when bellcrank lever arm 15 moves to locking position, best seen in FIG. 3, locking pin 33 can be released and will drop until wedged tightly between boss 53 and leading flange 35 of channel 31. In the event that the front edge of the door and stop 4 are not initially in tight abutment, any further movement of the door toward tight closure will increase the space between locking pin guiding flange 37 on the door and boss 53 on hasp 21, thereby permitting locking pin 33 to drop further into wedging engagement between these elements and preventing any back and forth movement of the door responsive to movements of the car, and resultant wear on the door and lock parts.

Figure 2:
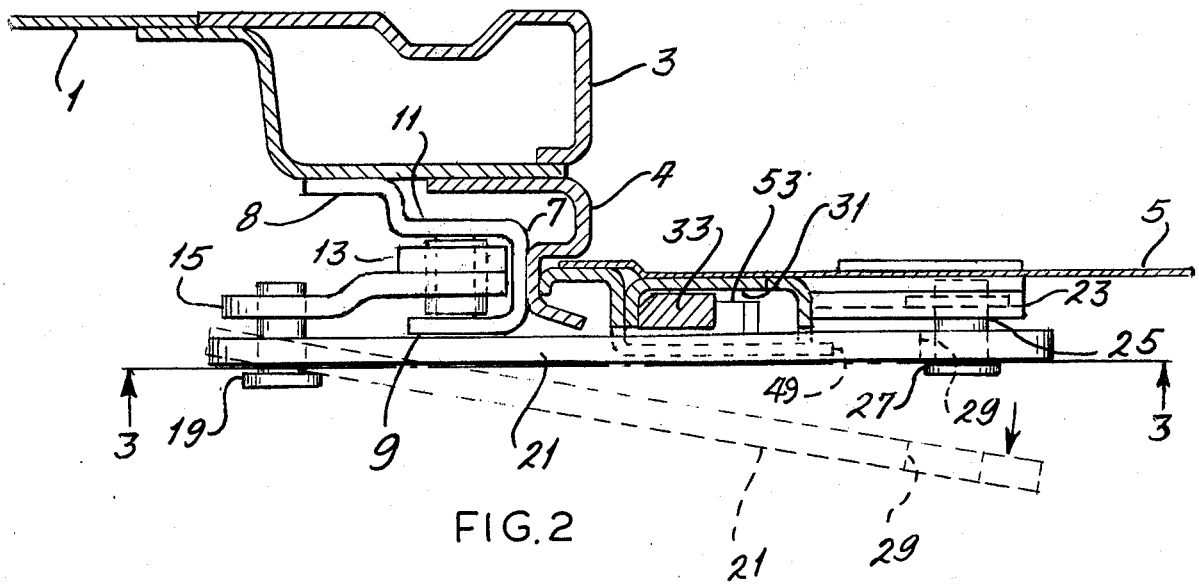
FIG. 2 is an enlarged horizontal sectional view taken along lines 2—2 of FIGS. 1 and 3.
Figure 4:
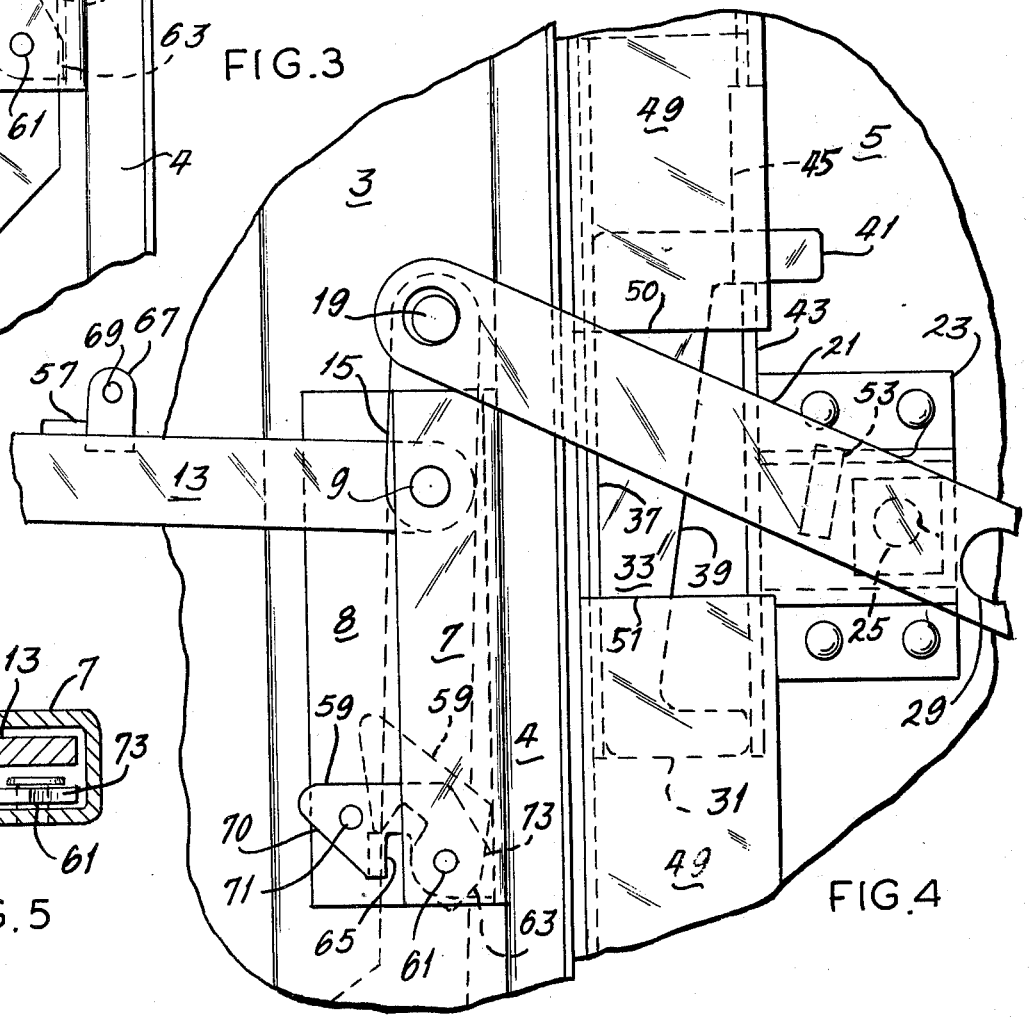
FIG. 4 is a view corresponding to FIG. 3 but showing the locking device in unlocked position.

By swinging bellcrank lever 13, 15 from the position of FIGS. 1–3 to that of FIG. 4 the lock may be released without manually withdrawing locking pin 33, locking pin 33 simply falling to the lowermost position permitted by engagement of its handle portion 41 with the bottom edge of channel flange cutout 45 so that, to permit relocking the door, locking pin 33 need only be lifted to the top position permitted by cutout 45 and held there during manual actuation of actuating levers 13, 15, 17.

For latching the locking device in locked position and permitting application of the shipper's car seal to the device, handle arm 13 is provided intermediate its ends with a transversely outwardly extending projection 57, and a plate-like latch member 59 is pivoted at 61 to the outer flange of channel bracket 7. Latch member 59 is formed with a normally vertical rear surface 63 engageable with the web of channel bracket 7 to limit downward pivoting of latch member 59 to the position shown in the drawings wherein the top of the latch member is horizontal. Intermediate its ends, the bottom of latch member 59 is upwardly indented to form a radially inwardly facing shoulder 65 which acts as a hook engageable with handle projection 57 to prevent movement of handle lever 13, 17 in a clockwise direction toward lock-release position while latch member 59 is horizontal, and requiring manual lifting (i.e., clockwise rotation) of latch member 59 until shoulder 65 vertically clears handle lever projection 57 to permit lock-release movement of the handle lever 13, 17. To permit application of a shipper's seal when the door is locked, handle lever 13 is formed with a tab 67 projecting from its front edge immediately above projection 57. Tab 67 and latch member 59 are formed with holes 69 and 71 positioned to be aligned transversely of the wall when the latch member is in latching engagement with handle arm projection 57, to permit passage therethrough of the shipper's seal (not shown) or, if desired of a padlock. To permit handle lever 13, 17 to be swung from horizontal release position to vertical locking position without manually lifting latch member 59 to clear projection 57, the outer end of latch member 59 is tapered as at 70 so that engagement of projection 57 with the tapered surface will lift the latch member to clear projection 57 about its pivot, after which latch member 59 will drop by gravity into latching engagement with projection 57. To ensure that latch member 59 will not at any time be swung so far counterclockwise about its pivot 61 that it will not automatically drop to its latching position, the upper portion 73 of the rear edge of latch member 59 is sloped so that when it engages the web of channel bracket 7, further rotational movement will be prevented.

Operation of the device is as follows: Latch 59 is lifted to clear handle lever projection 57 and handle lever 13, 17 is swung clockwise to permit the extension into the door opening of hasp 21. Door 5 is moved close enough to post 3 to permit hole 29 in hasp 21 to pass over head 27 of hasp connection pin 25 and the hasp is engaged with pin 25. Wedge locking pin 33 is then manually raised to its uppermost position, and handle 17 is used to rotate bellcrank lever 13, 15 counterclockwise from the position seen in FIG. 4 to that of FIGS. 1–3, after which wedge locking pin 33 is released and permitted to drop into wedging engagement between flange 37 and boss 53 on hasp 21, so as to hold the front edge of the door in tight engagement with stop member 4. During counterclockwise rotation of handle 17, projection 57 engaged tapered end 70 of latch member 59, raising the latter sufficiently to clear projection 57, and when lever arm 13 reached vertical locking position, latch member 59 rotated counterclockwise by gravity to place latch member shoulder 65 in opposed relation to projection 57. The shipper's seal may then be applied through aligned holes 69 and 71 and the car sent on its way.

On receipt by the consignee the seal may be broken, latch member 59 manually lifted, and release of the lock effected simply by swinging handle 17 and bellcrank lever 13, 15 clockwise, which will cause hasp 21 to move to the right and the door to move toward open position. When this occurs wedge locking pin 33 drops until its handle 41 engages the lower edge of opening 45 in locking pin channel flange 43, no manual withdrawal of the locking pin having been necessary. With hasp 21 no longer under tension, it may be easily disengaged from pin 25 on the door and permitted to swing clear of the door.

Variations in the details of construction may be made without departing from the spirit of the invention and the exclusive use of such modifications as come within the scope of the appended claims is contemplated.

We claim:

1. In combination with a sliding door and a relatively stationary member defining the front edge of a door opening, a locking device comprising an actuator mounted on said relatively stationary member, a hasp pivotally secured to said actuator and movable thereby from a rearwardly extended released position to a forwardly retracted locking position, structure mounted on said door spaced rearwardly from the front edge thereof including means for detachable connection to said hasp, means forming a transversely outwardly directed, rearwardly facing, transverse surface on said door between said detachable connection means and the front edge of the door, and a wedge-shaped locking pin vertically movably mounted on said door and slidably engaging said rearwardly facing transverse surface on said door, said hasp being positioned transversely outwardly of said locking pin when connected to said detachable connection means on said door, means on said hasp forming a transversely inwardly directed, forwardly facing, transverse surface thereon between said locking pin and said detachable connection means when said hasp is connected thereto whereby said locking pin is adapted to drop into locking engagement with said rearwardly facing transverse surface on said door and said forwardly facing transverse surface on said hasp when said door is closed, the portion of said hasp located transversely adjacent said locking pin when said door is locked being wholly transversely outboard of said hasp whereby to permit disconnection of said hasp from said detachable connection means on said door without requiring manual withdrawal of said locking pin from locking position.

2. A locking device according to claim 1 wherein said locking pin has a vertical front surface in slidable engagement with said rearwardly facing transverse surface on said door and a downwardly tapered rear surface engageable with said forwardly facing transverse surface on said hasp.

3. A locking device according to claim 1 wherein said actuator comprises a bellcrank lever adapted to be fulcrumed to said relatively stationary member on an axis transverse of the plane of the door, said hasp being secured to one arm of said lever and said other arm forming an operating handle.

4. A locking device according to claim 2 wherein said lever arms are substantially at right angles to each other, with said one arm pointing away from the door opening and said other arm pointing downwardly when in locking position.

5. A locking device according to claim 4 wherein the relative inclinations of said one arm and said hasp define an over-the-center toggle relationship when in locking position.

6. A locking device according to claim 1 wherein said door mounted structure includes a pocket vertically slidably receiving said locking pin.

7. A locking device according to claim 6 wherein said locking pin is formed with a handle projecting from said pocket to facilitate manual lifting of said locking pin.

8. A locking device according to claim 4 including a latch member pivotally mounted on said relatively stationary member and adapted to latchingly engage said other arm by gravitation when said other arm is in locking position.

9. A locking device according to claim 8 wherein said latch member has a downwardly open hook-like portion and said other arm is formed with a projection abuttingly engageable by said hook-like portion to oppose movement of said lever toward release position.

10. A locking device according to claim 9 wherein said latch member and said other arm are formed with holes aligned with each other when said other lever is in locking position.

11. A locking device according to claim 10 wherein said projection extends transversely from said other arm and said latch member has a sloping outer end edge adapted to be engaged by said projections as said other arm approaches locking position whereby to deflect said latch member upwardly about its pivotal mounting sufficiently to permit said other arm to seat in locking position.

12. A locking device according to claim 8 wherein said actuator includes a bracket adapted for fixed mounting on the relatively stationary member, said bracket being of vertically disposed channel form with its opening directed away from the door opening, said lever being fulcrumed to the flanges of said channel and received within said channel when in locking position, said latch member being pivoted to a flange of said channel.

13. A locking device according to claim 12 including stop means for limiting pivotal movements of said latch member between a horizontal latching position and a raised position clear of said other lever arm projection.

14. A locking device according to claim 2 wherein said actuator includes a bracket mounted on said relatively stationary member, said bracket being of vertically disposed channel form with its opening directed away from the door opening, said lever being fulcrumed to the flanges of said channel and received within said channel when in locking position.

* * * * *